US005742692A

United States Patent [19]

Garcia et al.

[11] Patent Number: 5,742,692

[45] Date of Patent: Apr. 21, 1998

[54] IN-THE-EAR HEARING AID WITH FLEXIBLE SEAL

[75] Inventors: Henri Garcia; Joseph F. J. M. Beumers; Rudi A. M. Claes, all of Eindhoven, Netherlands

[73] Assignee: U.S. Philips Corporation, New York, N.Y.

[21] Appl. No.: 407,433

[22] Filed: Mar. 17, 1995

[30] Foreign Application Priority Data

Apr. 8, 1994 [EP] European Pat. Off. ..... 94200961

[51] Int. Cl.[6] ..... H04R 25/00

[52] U.S. Cl. ..... 381/68.6; 381/69

[58] Field of Search ..... 381/68, 68.5, 68.6, 381/68.1, 69, 69.1, 69.2, 60, 23.1; 181/129, 130, 135

[56] References Cited

U.S. PATENT DOCUMENTS

| | | | |
|---|---|---|---|
| 2,430,229 | 11/1947 | Kelsey | 381/68.6 |
| 3,170,046 | 2/1965 | Leale | 381/68.6 |
| 3,852,540 | 12/1974 | Diethelm | 381/68.6 |
| 4,617,429 | 10/1986 | Bellafiore | 381/68.6 |
| 4,870,688 | 9/1989 | Voroba et al. | 381/68.6 |
| 5,031,219 | 7/1991 | Ward et al. | 381/68.6 |
| 5,195,139 | 3/1993 | Gauthier | 381/68.6 |
| 5,220,612 | 6/1993 | Tibbetts et al. | 381/68 |

FOREIGN PATENT DOCUMENTS

| | | | |
|---|---|---|---|
| 0533258 | 3/1993 | European Pat. Off. . | |
| 0043700 | 3/1983 | Japan | 381/68.6 |
| 1173657 | 12/1969 | United Kingdom | 381/68.6 |
| WO9325053 | 12/1993 | WIPO . | |

*Primary Examiner*—Huyen D. Le
*Attorney, Agent, or Firm*—Leroy Eason

[57] ABSTRACT

An in-the-ear hearing aid has a collar which can form a flexible seal in the bony part of the ear canal so as to reduce the occlusion effect. The collar comprises a tubular portion which is engageable against the wall of the ear canal, a fixing portion and a curved sealing portion. Owing to the use of this collar it is not necessary to make a mold of the bony part of the ear canal. This collar enables the hearing aid to be constructed in a manner such that it can be inserted so deep into the ear.

6 Claims, 3 Drawing Sheets

IN-THE-EAR HEARING AID WITH FLEXIBLE SEAL

BACKGROUND OF THE INVENTION

This invention relates to an in-the-ear hearing aid comprising a housing and at least one electroacoustic transducer, which housing has a comparatively wide portion situated near a first end of the housing and adjoining a comparatively narrow portion situated near a second end, which hearing aid is adapted to be fitted partly in a fleshy part and partly in a bony part of the ear canal and to form a seal for the ear canal in the bony part of the ear canal during use.

Such a hearing aid is known from WO93/25053 (herewith incorporated by reference). The known hearing aid has a rigid housing provided with a cover of a soft synthetic material. The rigid housing accommodates the normal hearing-aid components such as a microphone, an amplifier, a trimmer for adjusting the volume, an electroacoustic transducer for converting an electric signal into sound, and a battery. The housing has a comparatively wide portion which begins at a first end and a comparatively narrow portion which terminates in a second end. During use the wide portion is situated in a substantially fleshy part of the ear canal and the narrow portion is situated in a substantially bony part of the ear canal. In order to preclude undesirable acoustic feedback care must be taken to avoid acoustic leakage between the microphone and the electroacoustic transducer via a gap between the walls of the hearing aid and the ear canal. However, if the ear canal is sealed the user often complains of his own voice sounding hollow and booming. This so-called occlusion effect can be mitigated by arranging a seal as close as possible to the ear-drum. For this purpose the cover of the known hearing aid has such a shape at the location of the second end that near the ear-drum it can provide acoustic sealing of the space into which the transducer radiates its sound. In order to provide a satisfactory adaptation to the shape of the wall of the ear canal the cover is made of a soft polymer. However, upon deformation, since the cover has a thick wall at the location of the seal, the environment of the cover will be subjected to a force which increases strongly with the deformation. In addition, the bony part of the ear canal is of irregular shape and substantially non-deformable. In order to preclude discomforting stress on the wall of the ear canal, the above-mentioned cover should be shaped by means of a mould of the fleshy and bony part of the ear canal of the individual user. A method of making such a mould is described in EP-A-0, 533,258 (PHN 13.848), which corresponds to U.S. application Ser. No. 943,366, filed Sep. 10, 1992. A mould of the fleshy part can readily be made and differences in the shape of the hearing aid and the ear canal can be accommodated to some extent because the walls of the fleshy part are somewhat deformable. Making a satisfactory mould for the bony part is very difficult because the mould is liable to be deformed when it is removed from the ear owing to the substantially non-deformable walls of the bony part. Besides, small differences in the shape of the hearing aid and the bony part of the ear canal are likely to give rise to leakage of the seal or to uncomfortable pressure on the wall of the ear canal. Moreover, making a mould of the bony part often causes much discomfort to the user because it strains the ear-drum and the bony part is very susceptible to pressure.

Another problem of the known hearing aid is that jaw action of the user of the hearing aid may cause leakage of the seal. During jaw movement the fleshy part moves relative to the bony part so that locally the hearing aid is pressed to one side of the ear canal and a gap may be formed at the other side. Particularly in the case of hearing aids with a high gain this is likely to give rise to acoustic feedback, which manifests itself as a loud squealing sound.

One of the principal reasons why hearing aids have to be returned to the factory is soiling of the aperture in the housing through which the electroacoustic transducer emits its sound. This aperture becomes clogged by ear-wax in the ear canal and therefore this ear-wax should be removed at regular intervals by the user. Since the ear-wax hardens after some time removal may sometimes be impossible without damage to the hearing aid. The construction of the known hearing aid is such that the hearing aid can be repaired only by the manufacturer or by a specialised workshop.

SUMMARY OF THE INVENTION

It is an object of the invention to improve a hearing aid of the type defined in the opening paragraph so as to achieve an optimum wearing comfort without a mould of the entire bony part having to be made while a satisfactory sealing in the bony part is maintained even during jaw movement and the seal causes few or no complaints about the occlusion effect.

To this end the hearing aid in accordance with the invention is characterised in that for forming the seal in the bony part of the ear canal the hearing aid is provided with a collar comprising a tubular portion of a flexible material having a length of more than 2 mm, a fixing portion whose largest radial dimension is substantially smaller than the corresponding inner dimension of the tubular portion, and a curved portion of a flexible material which connects the end of the tubular portion which is remote from the first end to the fixing portion.

Owing to its flexibility the tubular portion can engage against the wall of the ear canal with a minimal pressure being exerted on the wall of the bony part of the ear canal. Tests have revealed that a satisfactory engagement in view of undesired acoustic feedback is obtained if the length of the tubular portion is selected to be greater than 2 mm. The cross-section of the ear canal is sealed by the curved portion which acts as a diaphragm and which is radially compressible owing to its curvature. Since the largest dimension of the fixing portion in a radial direction is substantially smaller than the corresponding inner diameter of the tubular portion and the curved portion is flexible, parts of the tubular portion can move in a radial direction without large forces, thus allowing the tubular portion to assume, for example, an oval shape. These features also allow the fixing portion to be off-centred in a radial direction without large forces being exerted on the wall of the ear canal and without the sealing action being lost. Owing to this off-centering tolerance it is not necessary to know the exact shape of the ear canal at the location of the seal in the bony part and the mould need not be formed in close proximity to the ear-drum. A mould which extends just past the second bend in the ear duct is adequate. This off-centering tolerance is also of importance during jaw movement of the user of the hearing aid because the fleshy part of the ear duct is then moved relative to the bony part, as a result of which the housing of the hearing aid will also move relative to the bony part. With the hearing aid in accordance with the invention undesired acoustic feedback during jaw movement is prevented. Another advantage is that insertion and removal of the hearing aid is more comfortable because the compressibility of the collar allows constrictions in the ear canal to be passed without excessive stress on the wall of the ear canal.

U.S. Pat. No. 5,220,612 describes another in-the-ear hearing aid. One of the embodiments disclosed therein has a flexible element at the narrow end, which is intended to seal the ear canal. However, in contradistinction to the seal in accordance with the invention, this element requires the use of a mould of the ear canal.

An embodiment of the hearing aid in accordance with the invention is characterised in that the largest radial dimension of the fixing portion is at the most 70% of the corresponding inner dimension of the tubular portion. Tests have revealed that by thus limiting the dimensions of the fixing portion satisfactory results can be obtained as regards wearing comfort and that in addition an effective sealing in the bony part of the ear canal is obtained.

An embodiment of the hearing aid in accordance with the invention is characterised in that the electroacoustic transducer extends at least partly inside the tubular portion. By arranging the transducer at least partly inside the tubular portion the total length of the hearing aid can be reduced and the first end of the housing can be fitted deeper in the ear canal, so that the hearing aid becomes less conspicuous.

An embodiment of the hearing aid in accordance with the invention is characterised in that the largest radial dimension of the part of the hearing aid which extends inside the tubular portion of the collar is at the most 70% of the corresponding inner dimension of the tubular portion. By thus limiting the dimensions of the part of the hearing aid disposed inside the tubular portion an optimum deformability of the tubular portion is achieved, so that it can conform to the oval cross-section of the bony part of the ear duct.

An embodiment of the hearing aid in accordance with the invention is characterised in that the tubular portion and the curved portion have a wall thickness of less than 0.5 mm. Limiting the wall thicknesses provides a satisfactory flexibility and a high deformability of the tubular portion and the curved portion. This step also enables the collar to be flattened in a radial direction to a dimension smaller than or equal to that of the fixing portion plus 1 mm. As a result, the hearing aid in accordance with the invention is also suitable for users having irregular and/or narrow ear canals.

An embodiment of the hearing aid in accordance with the invention is characterised in that the tubular portion is rotationally symmetrical. Such a collar can readily conform to the usually oval cross-section of the bony part of the ear canal regardless of the orientation of this oval cross-section. As a result, the orientation of this cross-section of the user's ear canal need not be taken into account when the tubular portion is fitted.

An embodiment of the hearing aid in accordance with the invention is characterised in that the tubular portion has an outer diameter of between 6 and 11 mm. By providing collars of diameters in a range between 6 and 11 mm the wearing comfort for the user can be optimised by the choice of the appropriate collar.

An embodiment of the hearing aid in accordance with the invention is characterised in that the collar is detachably secured to the housing of the hearing aid via the fixing portion. By making the collar detachable, for example, by means of a snap, clamping, screw-thread or bayonet connection, soiled, damaged or incorrectly fitting collars can also be replaced by the audiologist or the user. This enables many problems of the user to be solved locally and at low cost.

An embodiment of the hearing aid in accordance with the invention is characterised in that the collar is detachably secured to the electroacoustic transducer via the fixing portion. This embodiment provides all advantages outlined in the above paragraph and enables the radial dimensions of the hard parts disposed inside the tubular portion of the collar to be reduced in order to increase the deformability of the collar.

An embodiment of the hearing aid in accordance with the invention is characterised in that the tubular portion and the curved portion comprise a viscoelastic material.

This step provides a further improvement of the wearing comfort because in the case of deformation of an element of a viscoelastic material the force necessary to sustain the deformation decreases as a function of time immediately after application of the deformation owing to a reduction of material stresses. This means that shortly after insertion of the hearing aid the stresses on the wall of the ear canal decrease and the hearing aid causes less discomfort to the user.

An embodiment of the hearing aid in accordance with the invention is characterised in that the tubular portion and the curved portion comprise an acrylic polymer. This material can be manufactured with a Shore A hardness of less than 20 so that it is readily deformable. Moreover, the material can be rendered viscoelastic and can be dyed easily. Besides, this material can be polymerised with ultraviolet light.

An embodiment of the hearing aid in accordance with the invention is characterised in that it has a vent which connects a space surrounded by the tubular portion of the collar to an aperture in the first end of the housing. This step eliminates static pressure differences between said space and the environment of the user. These pressure differences arise particularly when the hearing aid is fitted into and removed from the ear canal. As a result of the flexibility of the collar and the fact that the collar presses only gently against the wall of the ear canal, this step will also reduce the build-up of pressure differences between the environment of the user and the space between the ear-drum and the collar.

An embodiment of the hearing aid in accordance with the invention, in which the electroacoustic transducer has an aperture through which sound can be emitted, is characterised in that the fixing portion has at least one duct which adjoins the aperture. One of the most frequent complaints is that the hearing aid no longer functions correctly because the aperture through which sound is emitted is clogged with cerumen. This embodiment prevents cerumen from settling directly on the electroacoustic transducer. The cerumen will now first settle in said duct in the fixing portion, which greatly reduces the likelihood of the electroacoustic transducer having to be replaced.

BRIEF DESCRIPTION OF THE DRAWINGS

The invention will now be described in more detail, by way of example, with reference to the accompanying drawings, in which.

It is to be noted that the embodiments are shown diagrammatically and the Figures are shown to an arbitrary scale, which is not always the same.

DESCRIPTION OF THE PREFERRED EMBODIMENTS

Figure 1:
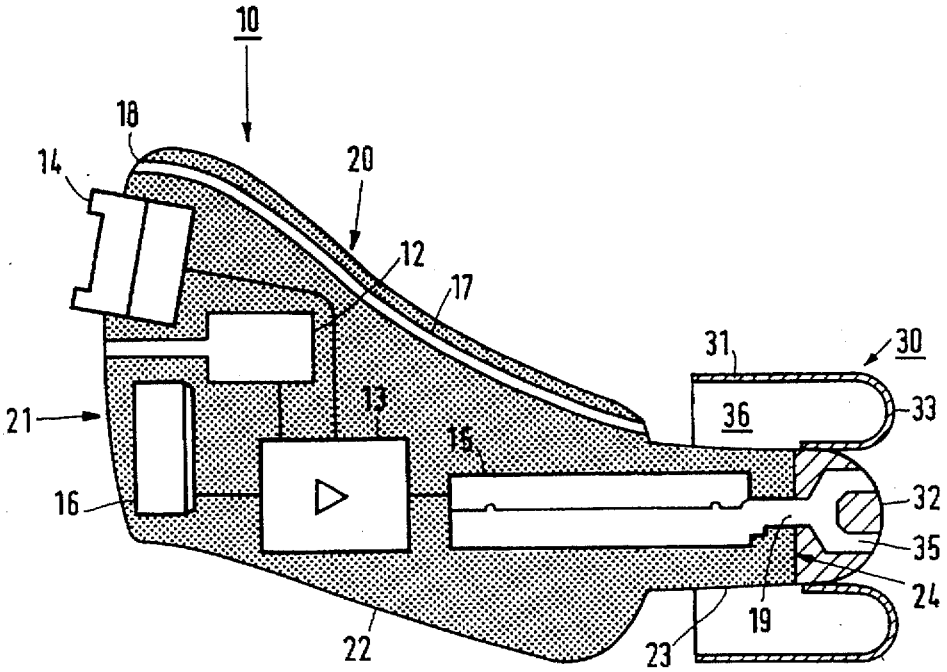
FIG. 1 shows an embodiment of the hearing aid in accordance with the invention.

FIG. 1 shows a hearing aid 1 having a housing 20. The housing 20 accommodates hearing aid components, shown diagrammatically and known per se, such as a microphone 12, an amplifier 13, a trimmer 14 for adjusting the volume, an electroacoustic transducer 15, and a battery 16. The housing 20 has a comparatively wide portion 22 which begins at a first end 21 of the housing and which adjoins a comparatively narrow portion 23 situated near a second end 24. A collar 30 is secured to the hearing aid 10 and has a tubular portion 31, a fixing portion 32 and a curved portion 33. The curved portion 33 connects an end of the tubular portion 31 which is remote from the first end 21 of the housing to the fixing portion 32. The tubular portion 31 and the curved portion 33 are of a flexible material and in the present embodiment these portions are integral with one another. The transducer 15 extends partly inside the tubular portion 31 of the collar 30.

Figure 2:
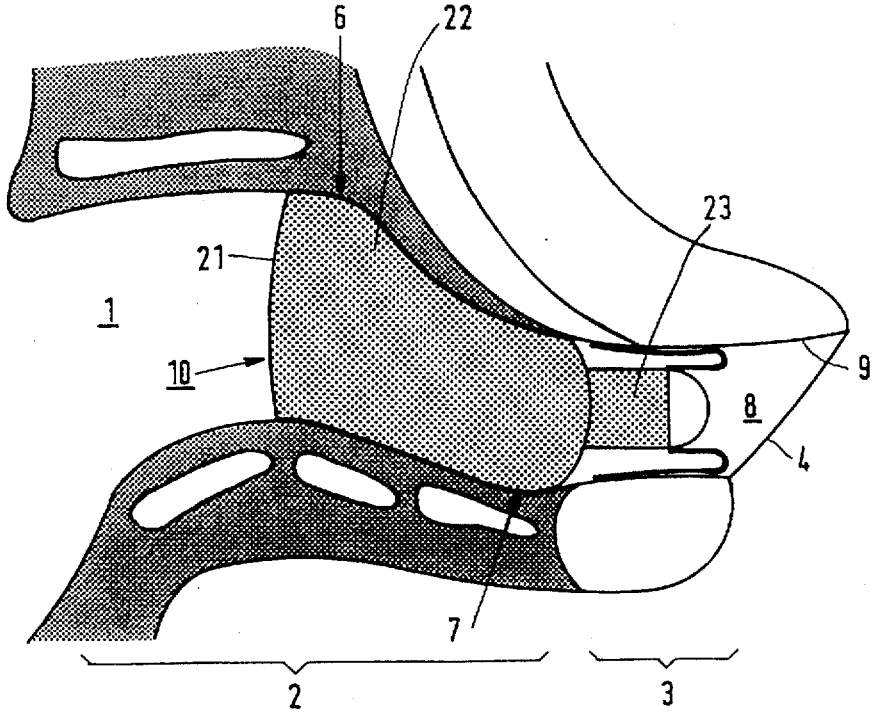
FIG. 2 is a sectional view of the ear canal with an embodiment of the hearing aid in accordance with the invention placed therein.

FIG. 2 shows diagrammatically an ear canal 1 comprising a fleshy part 2 and a bony part 3 terminating in an ear-drum 4. The hearing aid 10 in the ear canal 1 is adapted to be fitted partly in the fleshy part 2 and partly in the bony part. The wide portion 22 of the housing 20 is situated substantially in the fleshy part 2 and forms an acoustic seal in this part. The narrow portion 23 of the housing 20 is situated substantially in the bony part 3. In order to preclude undesirable acoustic feedback care must be taken to avoid acoustic leakage between the microphone 12 and the electroacoustic transducer 15 via a gap between the walls of the hearing aid 10 and the ear canal 1. However, if the ear canal 1 is sealed the user often complains of his own voice sounding hollow and booming. This so-called occlusion effect can be mitigated by arranging a seal as close as possible to the ear-drum 4. To this end the hearing aid 1 in accordance with the invention is adapted to form, in addition to the seal in the fleshy part 2, another seal in the bony part 3 of the ear canal 1. At the location of the second end 24 the collar 30 has such a shape that it can provide acoustic sealing in the bony part 3 near the ear-drum 4. Thus, the space into which the transducer 15 radiates its sound is acoustically isolated from the other parts of the ear canal 1. Since the transducer 15 extends partly inside the tubular portion 31 of the collar 30 the hearing aid 10 can be fitted so deep that the first end 21 of the housing 20 is disposed substantially at the location of the first bend 6 of the ear canal 1. This provides a result which is aesthetically very satisfactory.

Figure 3:
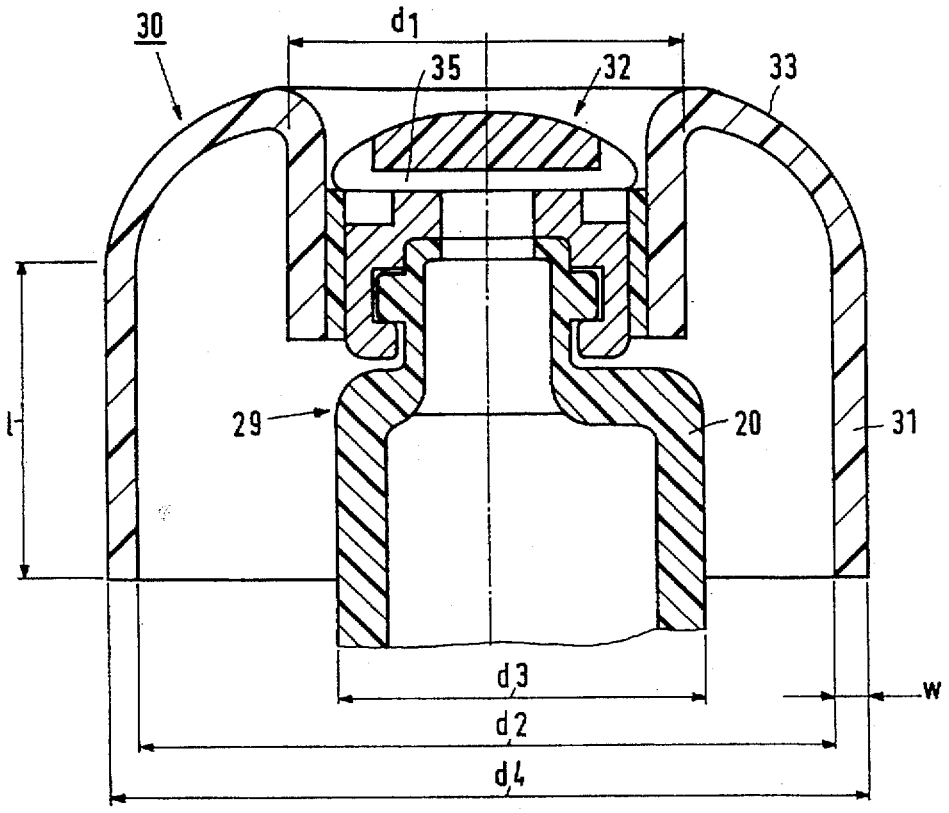
FIG. 3 is a longitudinal sectional view of the collar of an embodiment of the hearing aid in accordance with the invention.

FIG. 3 shows a greatly enlarged longitudinal sectional view of a part of the housing 20 and the collar 30. The collar 30 is detachably connected to the housing 20 by its fixing portion 32, in the present case via a bayonet coupling. This enables the collar 30 to be replaced simply by means of a suitable tool. This is because each radial dimension d1 of the fixing portion 32 of the collar 30 is substantially smaller than the corresponding inner dimension d2 of the tubular portion 31, so that the tubular portion can be pressed inward locally or wholly. Preferably, the largest radial dimension d1 of the fixing portion 32 of the collar 30 is at the most 70% of the corresponding inner dimension d2 of the tubular portion 31. In the present embodiment a part 29 of the hearing aid 10 also extends within the tubular portion 31 of the collar 30. Preferably, the largest radial dimension d3 of this part 29 of the hearing aid is also at the most 70% of the corresponding inner dimension d2 of the tubular portion 31. These steps provide enough room to prevent the fixing portion 32 or said part 29 of the hearing aid from pressing against the wall 9 of the bony part 3 via the tubular portion 31.

The tubular portion 31 has a length l of more than 2 mm. Tests have demonstrated that this provides an adequate sealing of the ear canal 1 to preclude undesirable acoustic feedback.

Preferably, the wall thicknesses w of the tubular portion 31 and the curved portion 33 are selected to be smaller than 0.5 mm. This provides a satisfactory flexibility and a high deformability of the tubular portion 31 and the curved portion 33. This step also enables the collar 30 to be radially flattened to a corresponding dimension smaller than or equal to that of the fixing portion 32 plus 1 mm. As a result, the hearing aid 10 in accordance with the invention is also suited for users with irregular and/or narrow ear canals.

In the embodiment shown in FIG. 3 the tubular portion 31 is rotationally symmetrical. Thus, the collar 30 can readily conform to the usually oval cross-section of the bony part of the ear canal 1 regardless of the orientation of this oval cross-section. As a result, the orientation of this cross-section of the user's ear canal need not be taken into account when the tubular portion 31 is fitted.

By providing collars 30 of outer diameters d4 in a range between 6 and 11 mm, the wearing comfort for the user can be optimised by the choice of the appropriate collar 30.

Figure 4:
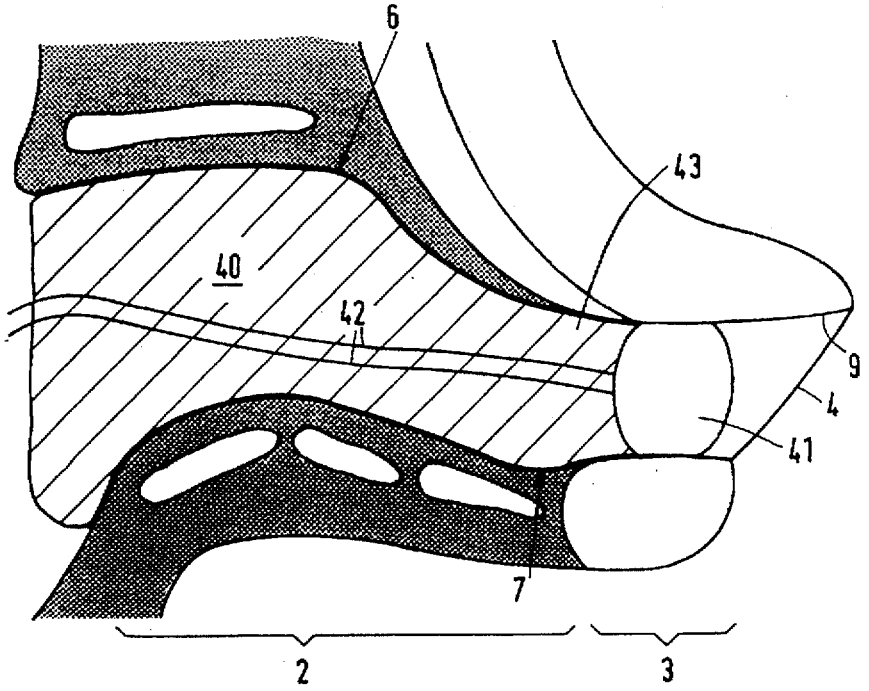
FIG. 4 is a sectional view of an ear canal in which a mould for making an embodiment of the hearing aid in accordance with the invention is disposed.

FIG. 4 shows diagrammatically how a conventional mould 40 of the ear canal 1 is made. A sealing plug 41 of a soft material is introduced into the bony part of the ear canal 1 of the prospective user of the hearing aid 10. Subsequently, a liquid material is poured into the ear canal 1, which material cures after some time. After curing a mould 40 is obtained, which is removed by means of strings 42 attached to the plug 41. After the mould 40 has been made the hearing aid 10 is manufactured as follows. The dimensions and the shape of the wide portion 22 of the housing 20 are determined by means of the mould 40. The narrow portion 23 of the housing 20 is made in conformity with the orientation of the last part 43 of the mould 40 formed just past the second bend 7 of the ear canal 1. A suitable diameter d4 for the collar is also selected by means of the last part 43 of the mould 40.

This method enables a part of the hearing aid 10 to be placed in the bony part 3 of the ear canal 1 and a seal to be formed at this location by means of the collar 30 without a mould of the bony part having to be made. This is a great advantage because it is very difficult to make a satisfactory mould of the bony part 3 because the substantially non-deformable walls 9 of the bony part often deform the mould as it removed from the ear canal 1. Moreover, making a mould of the bony part 3 often causes much discomfort to the user because it strains the ear-drum 4 and the bony part is very sensitive to pressure.

Figure 5:
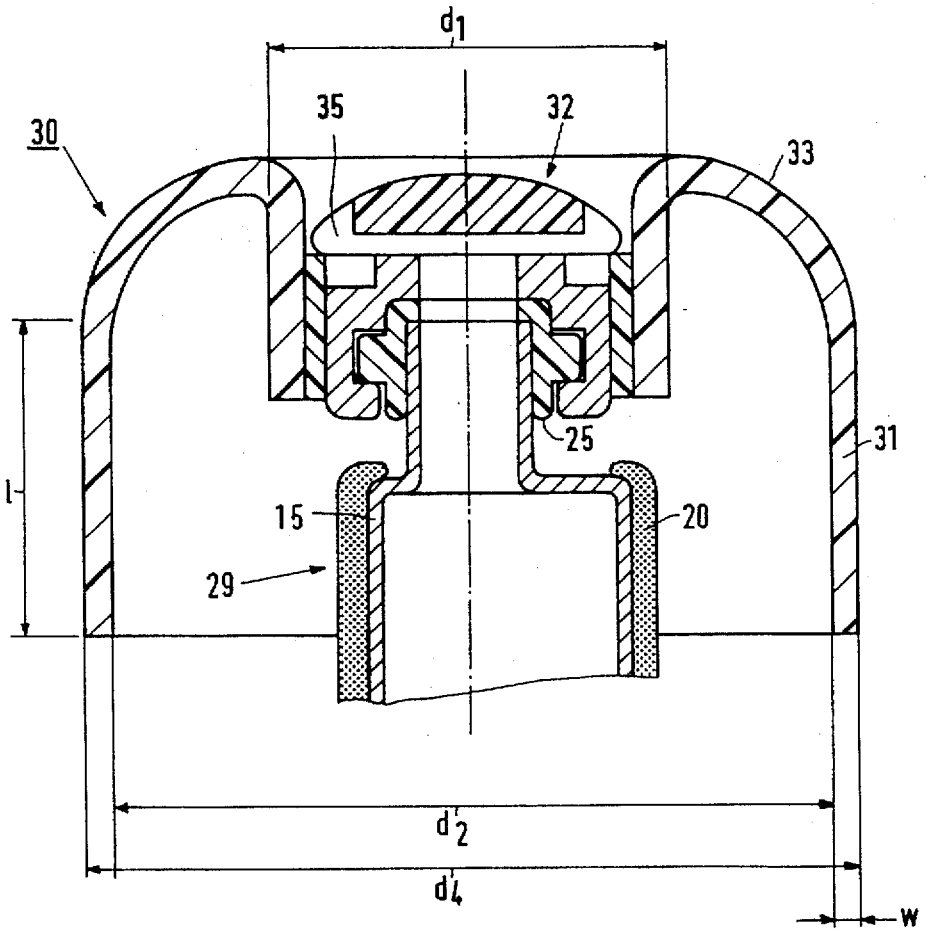
FIG. 5 is a cross-sectional view of the collar of another embodiment of the hearing aid in accordance with the invention.

FIG. 5 is a view similar to FIG. 3, showing an embodiment in which the collar 30 is secured to the electro-acoustic transducer 15 of the hearing aid 10 via the fixing portion 32. For this purpose the end of the transducer 15 is provided with a coupling element 25, to which the fixing portion 32 can be secured by means of a bayonet coupling. Securing the collar 30 to the transducer 15 is advantageous because the narrow portion 23 of the housing 20 can then be thin-walled and can be made of a soft material.

The fixing portion 32 is of such a construction that it can also function as a cerumen protector. The electroacoustic transducer 15 has an aperture 19 for radiating sound. To this end a duct 35, which during use connects the aperture 19 to the space 8 between the fixing portion 32 and the ear-drum 4, takes the form of a labyrinth (see FIG. 2). This precludes serious damage, which can arise if the transducer 15 becomes clogged with cerumen. If the fixing portion 32 is clogged beyond repair it can readily be replaced owing to the detachable connection.

The embodiment shown in FIG. 1 has a vent 17 which connects a space 36 surrounded by the tubular portion 31 of the collar 30 to an aperture 18 in the first end 21 of the housing 20. This step eliminates static pressure differences between said space 36 and the environment of the user. These pressure differences arise particularly when the hearing aid 10 is fitted into and removed from the ear canal 1. As a result of the flexibility of the collar 30 and the fact that the collar 30 presses only gently against the wall 9 of the ear canal 1 this step will also limit pressure differences between the environment of the user and the space 8 between the ear-drum 4 and the collar 30.

It is to be noted that the invention is not limited to the embodiments shown herein. Within the scope of the claims various other embodiments are possible, for example by the use of a snap, clamping or screw-thread connection for mounting the collar. Moreover, it is obvious that embodiments can be conceived which have, for example, a collar of oval shape.

We claim:

1. An in-the-ear hearing aid comprising:

a housing containing an electro-acoustic transducer, wherein the housing has a comparatively wide portion situated near a first end of the housing and adjoining a comparatively narrow portion situated near a second end of the housing, the hearing aid being adapted to fit partly in a fleshy part and partly in a bony part of a user's ear canal and to form, during use, a seal for the ear canal in the bony part thereof, wherein to form the seal in the bony part of the ear canal the hearing aid includes a collar which is fixed to the housing by means of a fixing element, wherein the collar comprises;

a tubular outer portion made of a flexible material and which, at a side remote from the first end of the housings ends in a curved portion made of a flexible material which in turn ends in a tubular inner portion coaxially arranged with respect to said tubular outer portion, wherein the fixing element extends at least partly inside of the tubular inner portion and has a largest radial dimension (d1) which is substantially smaller than a corresponding inner dimension (d2) of the tubular outer portion, and wherein the narrow portion of the housing extends at least partly inside of the tubular outer portion.

2. An in-the-ear hearing aid as claimed in claim 1 further comprising a vent which connects a space surrounded by the tubular portion of the collar to an aperture in the first end of the housing so as to eliminate any static pressure difference between said space and the environment of the user of the hearing aid.

3. The in-the-ear hearing aid as claimed in claim 1 wherein said tubular outer portion has a length of at least 2 mm and a diameter constant throughout its length, and said tubular inner portion of the curved portion is connected to the fixing element.

4. The in-the-ear hearing aid as claimed in claim 1 wherein the tubular outer portion is arranged to engage the bony part of the wall of the user's ear canal, a part of the narrow portion of the housing and a part of the electro-acoustic transducer extend inside of the tubular outer portion, and the curved portion functions as a diaphragm which is radially compressible so as to seal said bony part of the ear canal.

5. The in-the-ear hearing aid as claimed in claim 1 wherein the fixing element is secured to the tubular inner portion and a cross-section of the collar has approximately a U-shape.

6. The in-the-ear hearing aid as claimed in claim 1 wherein a part of the electroacoustic transducer extends inside of a part of the tubular outer portion, the largest radial dimension of the fixing portion is at most 70% of the corresponding inner dimension of the tubular outer portion, and the largest radial dimension of a part of the hearing aid housing which extends inside the tubular outer portion of the collar is at most 70% of a corresponding inner dimension of the tubular outer portion.

* * * * *